US006231425B1

(12) United States Patent
Inaba et al.

(10) Patent No.: US 6,231,425 B1
(45) Date of Patent: May 15, 2001

(54) POLISHING APPARATUS AND METHOD

(75) Inventors: Shoichi Inaba; Takao Katsuyama; Morimitsu Tanaka, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/252,659

(22) Filed: Feb. 19, 1999

(30) Foreign Application Priority Data

Aug. 18, 1998 (JP) ..... 10-231956

(51) Int. Cl.[7] ..... B24B 49/00; B24B 5/00

(52) U.S. Cl. ..... 451/5; 451/9; 451/287; 451/443; 451/41; 451/56

(58) Field of Search ..... 451/5, 9, 287, 451/443, 285, 288, 41

(56) References Cited

U.S. PATENT DOCUMENTS

| | | | | |
|---|---|---|---|---|
| 5,609,511 | * | 3/1997 | Moriyama et al. | 451/5 |
| 5,639,388 | * | 6/1997 | Kimura et al. | 451/41 |
| 5,876,265 | * | 3/1999 | Kojima | 451/11 |
| 5,904,609 | * | 5/1999 | Fukuroda et al. | 451/41 |
| 5,975,997 | * | 11/1999 | Minami | 451/41 |
| 6,093,080 | * | 7/2000 | Inaba et al. | 451/5 |

FOREIGN PATENT DOCUMENTS

| | | |
|---|---|---|
| 10-15807 | 1/1998 | (JP) . |
| 10-315124 | 12/1998 | (JP) . |

OTHER PUBLICATIONS

S. Inaba et al., "Study of CMP Polishing Pad Control Method", 1998 Proceedings Third International Chemical–Mechanical Planarization for ULSI Multilevel Interconnection Conference (CMP–MIC), Feb. 19, 1998, pp. 44–51.

* cited by examiner

*Primary Examiner*—M. Rachuba
(74) *Attorney, Agent, or Firm*—Young & Thompson

(57) ABSTRACT

A polishing apparatus and method capable of polishing stably regardless of variation between polishing objects, change of a polishing means with lapse of time etc. The apparatus includes polishing pad 1, polishing table 3 with the polishing pad 1 adhered thereto, table motor 8 for driving the polishing table 3, conditioning means 5 for conditioning the polishing pad 1 at the same time of polishing and conditioning control system 12 for setting a conditioning condition during polishing. According to a polishing method of the present invention, a conditioning condition of the polishing pad 1 can be set so as to make a torque current 10, which is proportional to a friction force exerted between the polishing pad 1 and the wafer 2, constant, and thereby polishing speed can be stabilized.

14 Claims, 12 Drawing Sheets

POLISHING APPARATUS AND METHOD

FIELD OF THE INVENTION

The present invention relates to polishing apparatus and method, more especially to polishing apparatus and method for polishing substrates, in particular a semiconductive substrate among them.

BACKGROUND ART

FIGS. 14(A) and 14(B) show a conventional polishing apparatus for polishing a wafer (substrate). Referring to FIGS. 12(A) and 12(B), according to the conventional polishing apparatus, a wafer 2 is polished through the steps of dropping a droplet of a slurry, which contains an abrasive agent and which is fed from a slurry feed means 6, on a polishing pad 1 adhered to a rotatable polishing table 3, pressing the wafer 2 rotated by a spindle 7 against the polishing pad. In order to remove debris and the like which clog traps (grooves) formed on the surface of the polishing pad 1, conditioning of a polishing pad (called as "Ex-SITU conditioning") is performed by using a diamond disc 5 installed on a conditioning drive means 4 in the interval of one and next polishing steps (runs).

Conventionally, conditioning conditions have been determined by practicing a pilot operation before advancing an actual polishing step of polishing a wafer which is to be changed into a product. Explaining in more detail, according to the prior art method, a conditioning condition is set as follows. Many pilots (blank wafers) are polished changing the conditioning time. The thickness of each pilot is measured after a given time of polishing. When the pilot thickness coincides with the set thickness, the corresponding conditioning time is taken as a conditioning condition. In case of polishing wafers belonging to the same lot group or the same patterned group, the above pilot procedure by using one blank wafer per several ten pieces of lots is taken, and the conditioning time is determined on the result of this procedure.

SUMMARY OF THE DISCLOSURE

However, the following problems are involved in the aforementioned prior art.

First problem is a change of a polishing speed (polishing and removing rate) with lapse of time, which offers a fear of polishing a wafer excessively.

This is because a polishing condition varies depending on disorder such as the change of a polishing pad in its surface state, variation between lots, ununiformity of an abrasive agent and the like.

Second problem is complication of calculation for determining a conditioning condition (or formulation of a recipe).

This is because the determination of a conditioning condition is required for every part different in properties by correspondingly performing a pilot operation according to the conventional method of setting the conditioning condition, since the degree of lowering a polishing efficiency due to the fatigue of a polishing pad, clogging and the like changes depending on the kind of polishing object (kind of film and the like) and device pattern formed on a wafer.

Accordingly, an object of the present invention is to provide a polishing apparatus and method capable of stably polishing a substrate regardless of the difference in polishing objects, change of a polishing means with lapse of time and the like.

A polishing apparatus of the present invention includes a polishing device polishing a substrate, a conditioning device conditioning the polishing device during polishing the substrate and a conditioning control system which controls the conditioning device based on a friction force exerted between the polishing device and the substrate during polishing the substrate.

In a polishing method of the present invention, the friction force exerted between the polishing device and the substrate is detected during polishing the substrate, and the polishing device is conditioned during polishing the substrate based on the detected friction force.

According to the present invention, information for setting the conditioning condition of the polishing device can be obtained during polishing the substrate so that it is needless to practice a pilot operation for obtaining a conditioning condition in the interval of runs. Further, a partial information corresponding to a partial property can be obtained during polishing the substrate in case that properties of a substrate (for example, device patterns or kinds of film) are partially different from each other. Accordingly, it is easy to set optimum conditioning conditions which are partially different from each other based on the partial information.

Moreover, an information for setting the conditioning condition of the polishing device can be obtained during polishing the substrate to become a product. This information is then fed back to the conditioning control system. Accordingly, an appropriate conditioning condition can be set instantly against disorder such as variation between lots, difference of patterns each formed on substrates and change of the polishing device with lapse of time and the like to stabilize sufficiently polishing speed (removal rate) and total polishing amount only by controlling the time.

BRIEF DESCRIPTION OF DRAWINGS

FIG. 4(A) shows the surface sate of a polishing pad just before polishing.

FIG. 14(A) is a front view.

PREFERRED EMBODIMENTS OF THE INVENTION

In the following, principles which underlies the present invention and preferred embodiments of the present invention will be explained in reference to the accompanying drawings.

Figure 2:
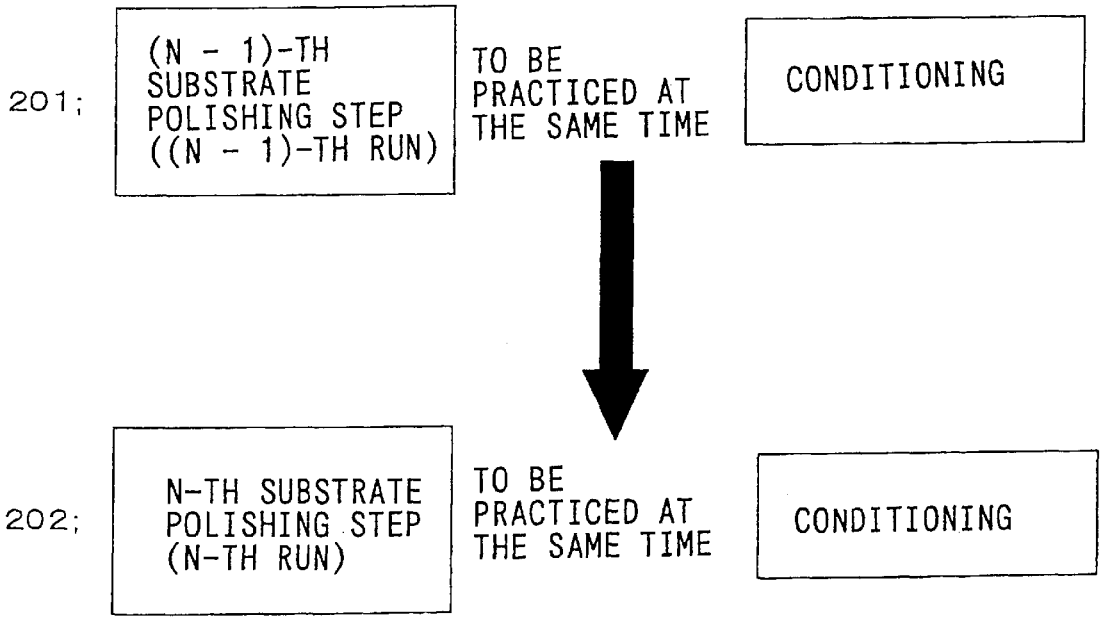
FIG. 2 is a view showing a polishing sequence in case of applying In-SITU conditioning.

In the present invention, "In-SITU conditioning", that is the conditioning of a polishing device (means) carried out during polishing steps, i.e., at the same time of polishing is applied. FIG. 2 is an explanatory view showing a polishing sequence in which the In-SITU conditioning is applied. As shown in FIG. 2, the conditioning of a polishing device is practiced at the same time of practicing (n−1)-th run (polishing) in this polishing sequence while single or plural substrates are mounted on a polishing apparatus (step 201). After finishing (n−1)-th run, the conditioning of the polishing device is practiced in the same manner as practiced in the above at the same time of practicing (n−1)-th run (polishing) (step 202).

Here, the polishing speed (removing rate) of a wafer, which is polished with a polishing pad by using a polishing apparatus shown in FIG. 1 details of which will be explained in the paragraph of Example, is commented on before explaining In-SITU conditioning model (In-polishing-step conditioning model) proposed by the present inventors. The result regarding the change of the polishing speed measured under the following polishing condition with lapse of time is shown in FIG. 3.

Polishing condition (polishing load: 7 psi, number of revolution of a polishing table: 20 rpm, number of revolution of a spindle: 20 rpm, flow rate of a slurry: 100 cc/min., conditioning condition, number of revolution of a polishing table: 20 rpm, conditioning time: 2.2 sec×20 sector=44 sec, diamond disc: 4 inch–#100 diamond, slurry SS-25: pure water=1:1, polishing pad: IC-1000-Suba 400, wafer for polishing: 10000 AP/TEOS film)

Figure 3:
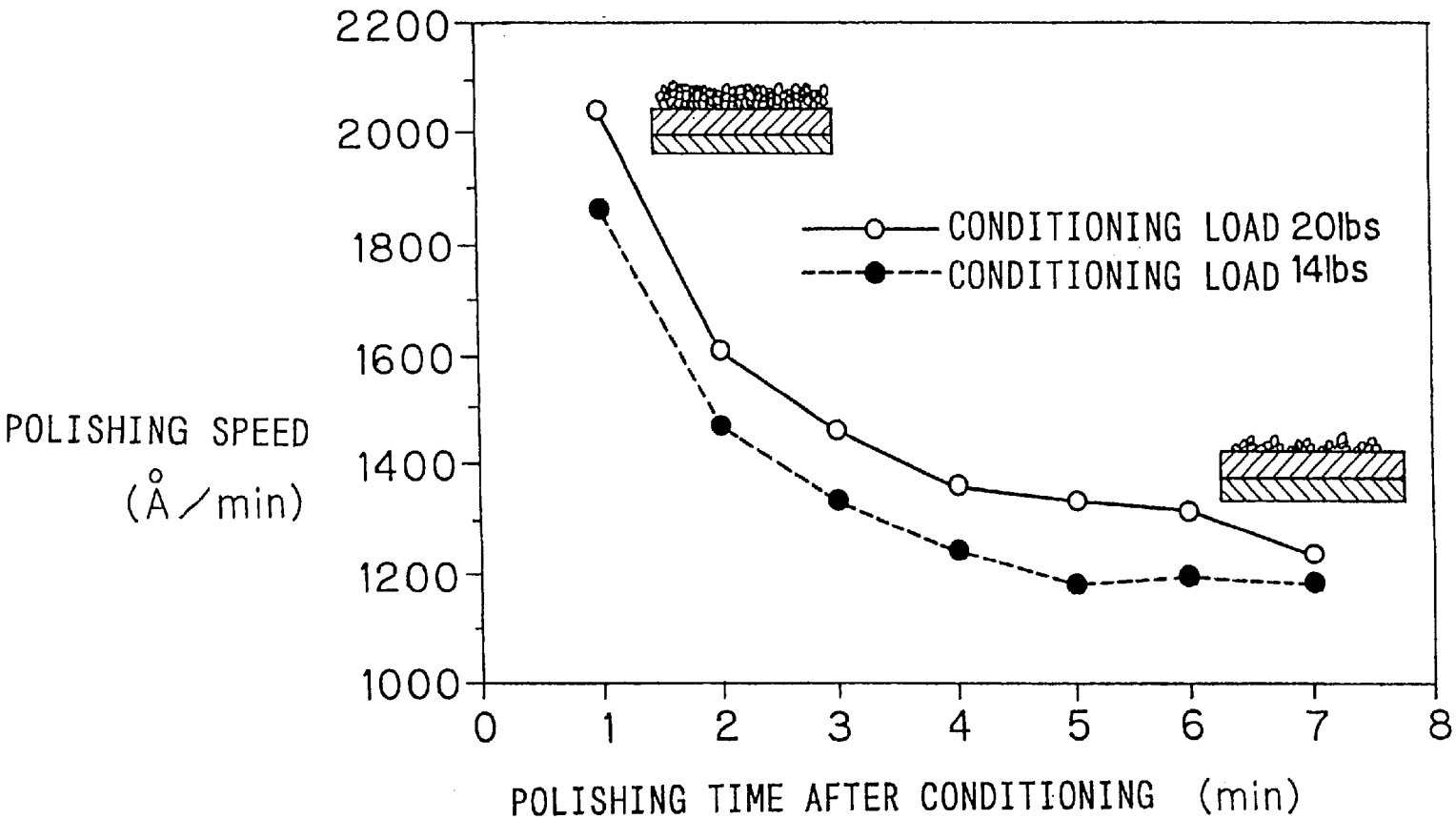
FIG. 3 is a graph for explaining the change of a polishing speed with lapse of time in a polishing step.

As shown in FIG. 3, a polishing speed tends to decrease gradually with lapse of time and becomes constant after the lapse of certain period of time. The present inventors proposed an In-SITU conditioning model in order to explain the change of the polishing pad in its surface state.

Figure 4:
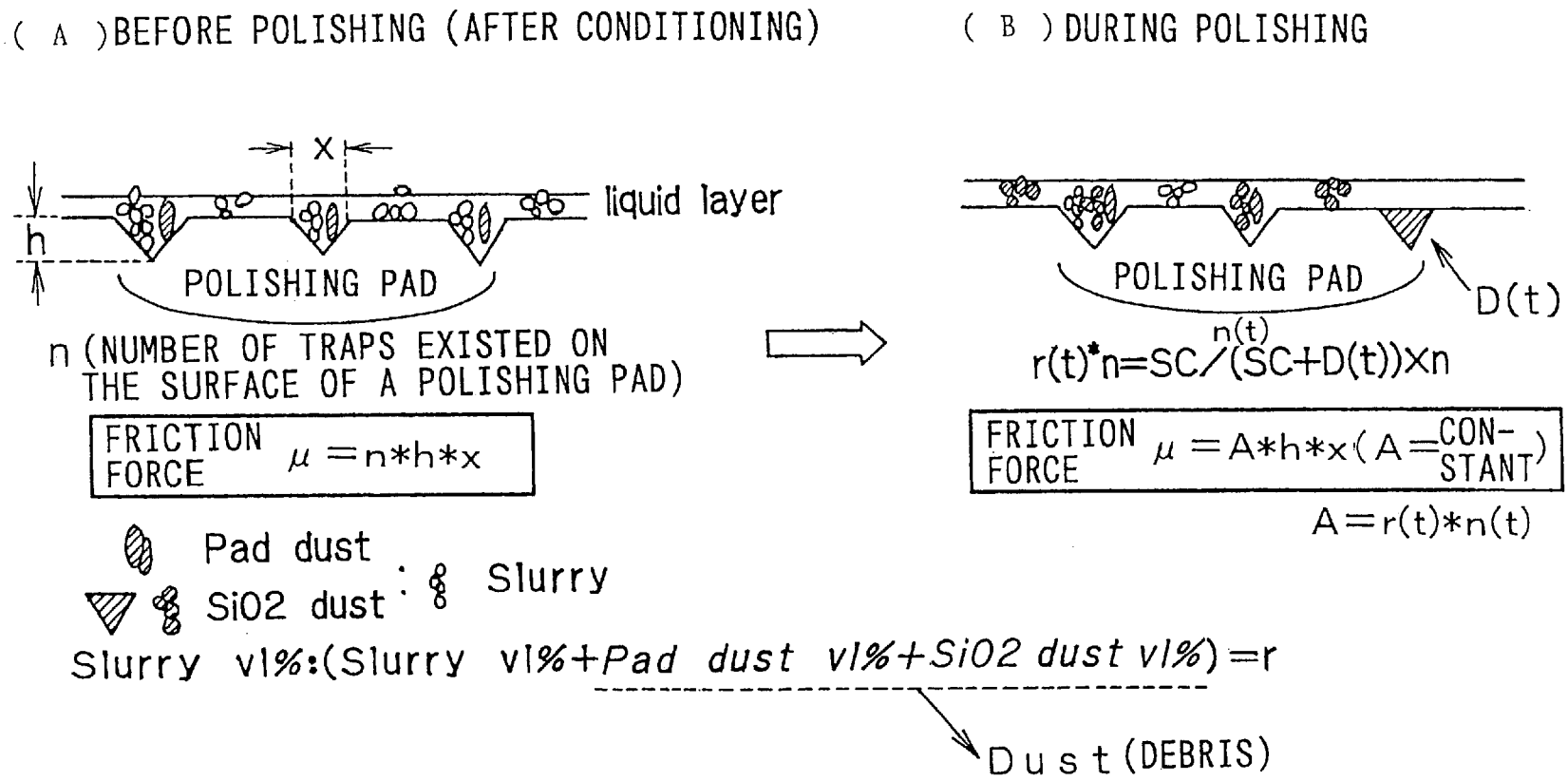
FIGS. 4(A) and (B) are a view showing an In-SITU conditioning model.
FIG. 4(B), the same sate in polishing.

FIGS. 4(A) and 4(B) are a view of an In-SITU conditioning model. FIG. 4(A) shows the surface state of the polishing pad just before polishing; FIG. 4(B), that during polishing.

Referring to FIG. 4(A), if it is supposed that all of the traps (grooves which hold abrasive grains) existed on the polishing pad works efficiently or ideally just before the start of polishing, a friction force $\mu$ exerted between the polishing pad and a substrate immediately after the start of polishing the substrate can be represented by "$\mu$=n×h×X". Here, n, h and X represent parameters which show the initial state of the polishing pad, where n is effective number of traps existed on the polishing pad in the initial state; h, effective depth of the traps in the initial state; and X, effective width of the traps in the initial state.

As shown in FIG.(B), polishing the substrate generates polishing pad dust (Pad dust) and substrate debris (dust of polished substrate) such as $SiO_2$ dust on the polishing pad after the lapse of a given period of time from the start of polishing. When an initial density of a slurry is SC, and a dust density after t hours lapsed from the start of polishing is D(t), an effective slurry density after t hours lapsed from the start of polishing can be represented by SC/{SC+D(t)}.

Then, the traps on the surface of the polishing pad is gradually loaded by the generated dust. Here, n(t) denotes an effective number of traps which the polishing pad has after the lapse of t hours.

An identical equation of A (constant)=r(t)×n(t) is expected to be ideally established under the In-SITU conditioning condition.

Accordingly, a friction force $\mu$ (t) exerted between the polishing pad and the substrate after the lapse of t hours from the start of polishing can be represented by "$\mu$(t)=r(t)×n(t)×h×X=A×h×X", where A is a constant. Here, the effective depth and width of the traps can be changed during polishing depending on a conditioning condition such as conditioning load and the like. Accordingly, it will be understood that the friction force generated between the polishing pad and the substrate during polishing the substrate can be controlled during polishing the substrate by controlling the condition of the conditioning which is to be performed during polishing the substrate.

Figure 5:
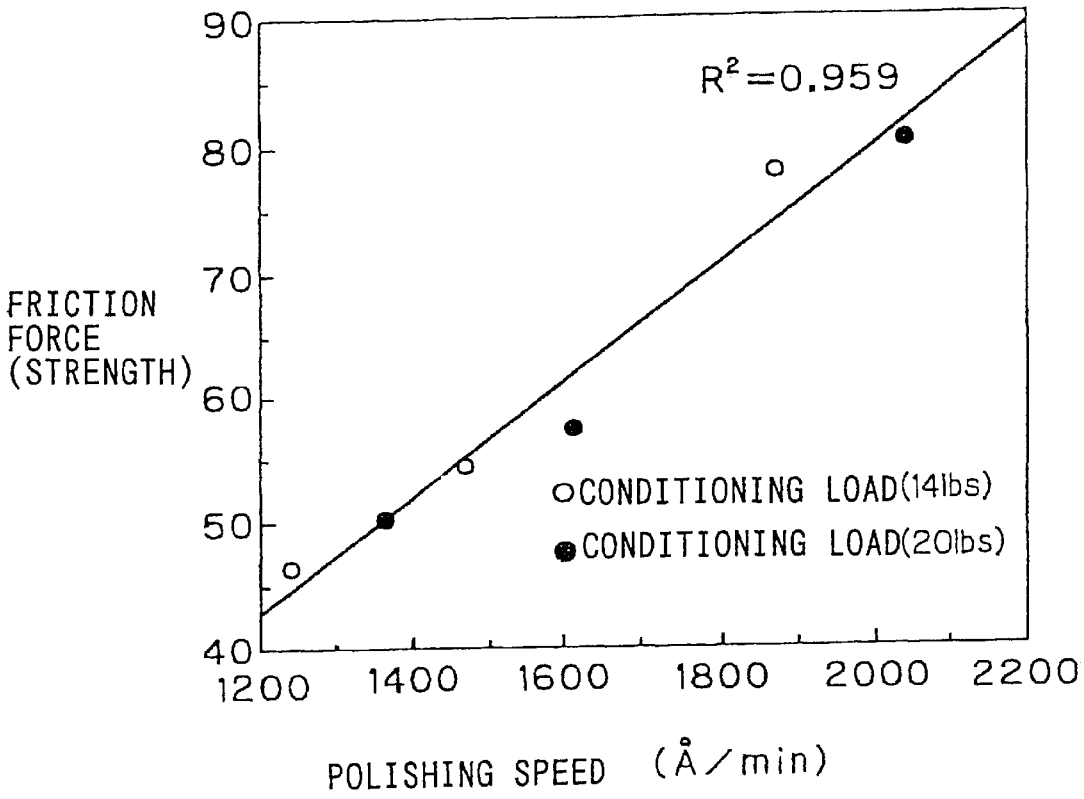
FIG. 5 is a graph showing the relation of polishing speed and friction force.

From the above equation and the aforementioned measurement result shown in FIG. 3, the relation of the substrate polishing speed and the friction force exerted between the polishing pad and the substrate was determined. FIG. 5 is a graph showing the relation of the polishing speed and the friction force. As shown in FIG. 5, there is high correlation ($R^2$=0.959) between them. Accordingly, it will be understood that the friction force exerted between the polishing device and the substrate as well as the substrate polishing speed can be controlled by changing the condition of the conditioning which is to be performed during polishing the substrate.

It is considered that polishing yield can be improved by controlling the polishing speed in such manner, since harmful effects such as delay due to the decrease of the polishing speed, damage due to the increase of the polishing speed and the like can be avoided by controlling the polishing speed in the above manner, and accordingly, the substrate can be always polished in a constant condition.

The following is the explanation of a method for setting a conditioning condition according to one embodiment of the present invention. In this embodiment, the conditioning condition is set on the basis of a torque current (hereinafter referred as to "polishing table torque current"), which is supplied to a motor for driving a polishing table, by using a polishing table with a polishing pad adhered thereto as a polishing device and a diamond grinding wheel as a conditioning device.

In the polishing table torque current, each of instant torque current I(t) and the sum of the torque currents σI(t) (or integrated value) required for a given period of time closely correlates to the polishing speed and the sum of the polished amount, and can be represented by the following formula.

$$I(t)=K\times\text{instant polishing speed} \quad (1)(K\text{: constant})$$

$$\sigma I(t)=K\times\text{total polished amount} \quad (2)(K\text{: constant})$$

The above formula (1) indicates that the instant polishing speed is controllable on the basis of the instant torque current I(t). And, the above formula (2) indicates that the total polished amount is controllable on the basis of the sum of the torque currents flowing during polishing. The relation of conditioning condition and polishing speed, polished amount will be explained as follows.

As explained above in reference to FIG. 4(A), the friction force $\mu$ (t) after the lapse oft hours from the start of polishing can be represented as follows.

$$\mu(t)=r(t)\times n(t)\times h\times X \quad (3)$$

In the formula (3), A (constant)=r(t)×n(t), r(t) is an effective slurry density after t hours from the start of polishing; n(t), an effective number of traps after t hours from the start of polishing; h, an effective depth of the traps; and X, an effective width of the traps.

The above parameters n(t), h and X are determined depending on the conditioning condition during polishing. Accordingly, the following formula is established.

$$n(t)=B\times s\times v \quad (4)(B\text{: constant})$$

or $$n(t)=n=B\times s\times v \quad (4)'(B\text{: constant})$$

when s and v are constant.

In the above formula (4), s (variable) is a number of a table rotation which can be controlled without any influence on polishing by, for example, temporarily putting a polishing object out of the way; v (variable), a sector residence time (sweep time). Here, the term "sector" means a plane resulting from sectioning the surface of the polishing pad into several pieces; the term "sector residence time", a time required for conditioning a certain sector.

$$h=C\times f\times d \quad (5)(C\text{: constant})$$

$$X=D\times d \quad (6)(D\text{: constant})$$

In the above formula (5), f is a conditioning load, and in the above formula (6), d is a grain size of diamonds contained in a diamond disc.

The formula (3) can be transformed as follows by using these formulae.

$$\text{Friction force } \mu(t)\ \text{constant}\times fsvd\times r(t)\times n(t) \quad (7)$$

In the above formula, "fsvd" represents a function F(f,s, v,d) of variables f, s, v and d.

In the above formula (7), r(t)×n(t) is considered constant based on the In-SITU conditioning which proceeds concurrently with polishing. Accordingly, the following formula is derived from the formula (7).

$$\mu(t)=\text{constant}\times fsvd \quad (8)$$

In case that, for example, "s" and "v" are constant, r(t) and n(t) are considered constant. Thus the following formula is established according to the formula (4)'.

$$\mu(t)=\text{constant}\times fd \quad (8)'$$

Here, the polishing table torque current required for driving the polishing table at a fixed number of revolution is proportional to the friction forth. Accordingly, the following formula is derived from the formula (8).

$$\text{Torque current } I=\text{constant}\times\mu(t)=\text{constant}\times fsvd \quad (9)$$

It will be understood that the above formula (9) indicates that the torque current I can be controlled depending on one or more of conditioning conditions. Accordingly, it will be understood that the torque current or the friction force can be controlled to be constant by changing one or more of the conditioning conditions on the basis of the formula (9), and consequently that the polishing speed can be controlled to be constant in a polishing step. Thereby, the variation (difference) of the total polished amount between the polishing steps (runs) can be minimized (or stabilized).

The preferred embodiments of the present invention will be explained as follows.

Figure 1:
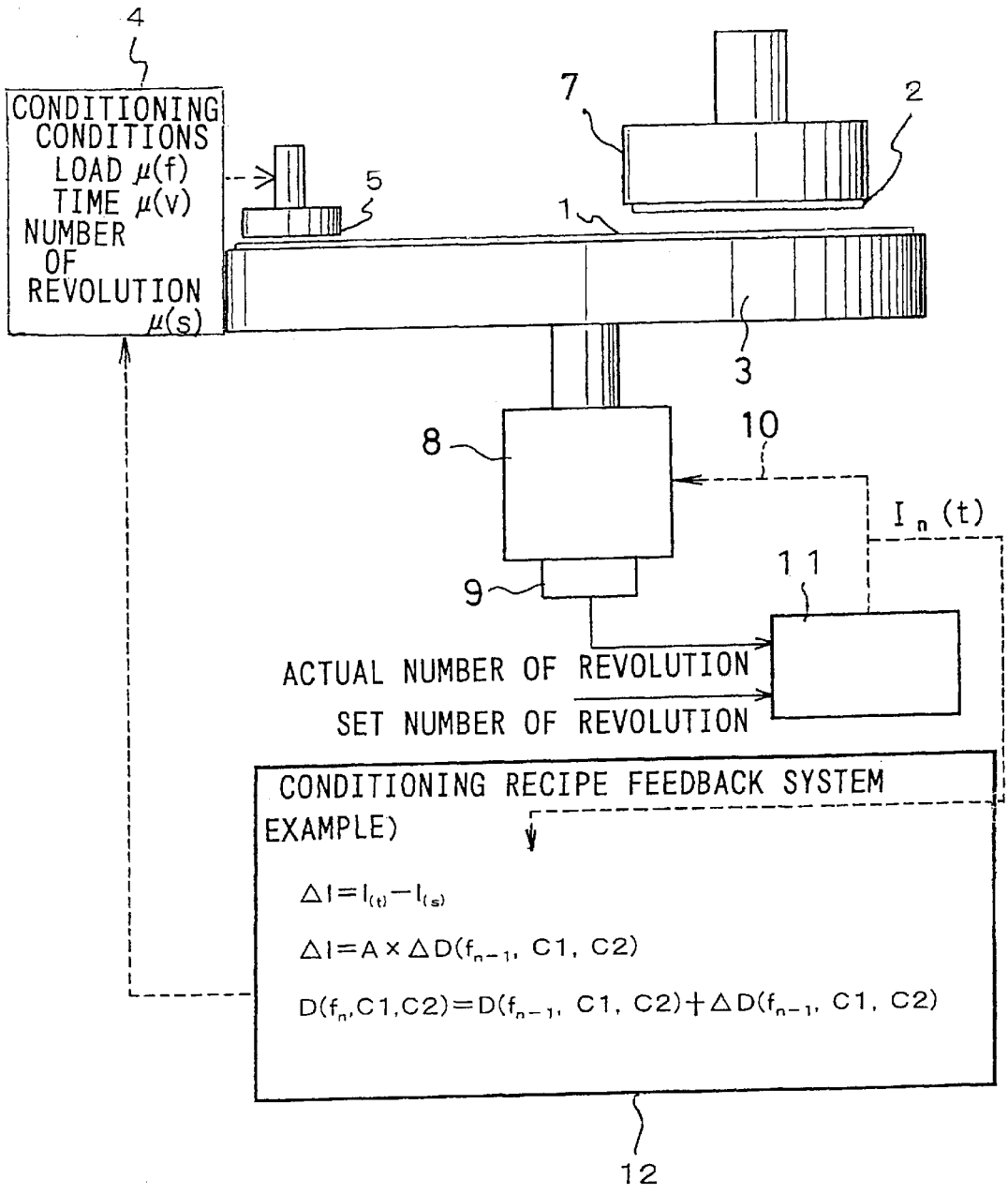
FIG. 1 is a view showing an exemplary polishing apparatus of the present invention.

A polishing apparatus of the present invention in its preferred embodiment includes a torque current detection means (unit) which can detect a torque current signal ("10" in FIG. 1) and output the signal to a conditioning control system ("12" in FIG. 1). The conditioning control system includes a setting means (unit) for setting a conditioning condition so as to make an instant current, or an integrated or total torque current required for a given period of time constant each other on the basis of a detection signal ("In(t)" in FIG. 1) input from the torque current detection means.

According to the present invention, in the preferred embodiment of the polishing apparatus, next conditioning load can be set by the above setting means based on the variation (difference) of the torque current signal and present conditioning load.

In the preferred embodiment of the present invention, a control signal of a motor for driving a polishing table or a signal corresponding to a number of the revolution of the polishing table or of the motor may be applied as a signal which is substantially proportional to a friction force. A conditioning condition can be set, for example, by using as a polishing means a polishing table, to which a polishing pad is adhered and which is driven by a direct-current motor whose number of revolution can be controlled to be constant, on the basis of a torque current flowing through the direct-current motor or of a control signal of the direct-current motor.

The conditioning control system may be composed of a circuit into which the polishing table torque current is input, which operates or calculates based on the input signal to set a conditioning condition, and from which a control signal corresponding to the set conditioning condition is output.

The conditioning condition to be set includes, for example, load of a conditioning device against the polishing device, number of revolution of the polishing device (polishing table 3 in FIG. 1),conditioning device (diamond disc 5 and spindle 7 in FIG. 1), conditioning time and roughness of the conditioning means. As the conditioning device, grinding wheel, brush or other dresser can be used. The conditioning condition can be changed by adjusting grain size and/or hardness of abrasive grains in case of using a grinding wheel, or by adjusting diameter and/or hardness of brush hairs in case of using a brush.

Another conditioning condition includes feed or density of an abrasive agent and strength of absorbing debris from the top of the polishing device. It is preferable to provide a polishing apparatus with a vacuum means for absorbing the debris on a polishing pad and to absorb the debris so as to make the on-state of the polishing pad such as effective number of traps, effective slurry density or the like invariable.

Figure 6:
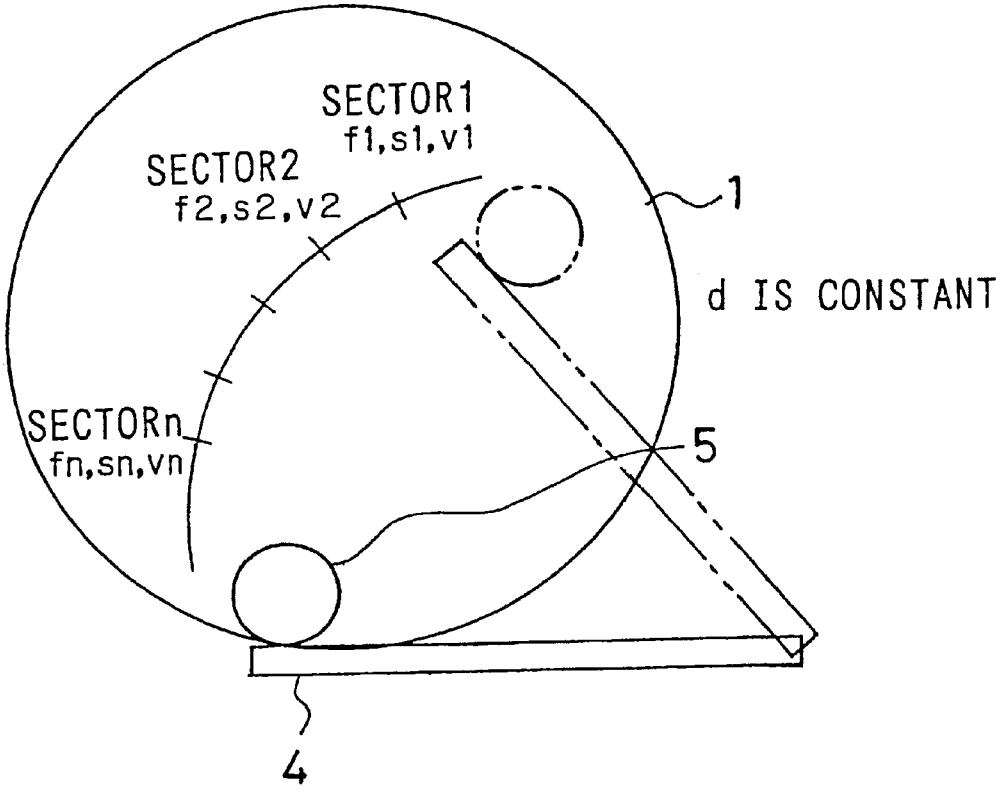
FIG. 6 is an explanatory view of a method for setting conditioning conditions for every sector of a polishing pad.

It is preferable to set the conditioning condition particularly for every sector of the polishing pad. FIG. 6 is an explanatory view of a method for setting the conditioning condition for every sector. In this figure, each of sector 1, sector 2, . . . , and sector n represents a divided surface area of the polishing pad; f, a conditioning load (load applied to a diamond disc 5); s, a number of revolution of the polishing table; v, a residence time of the diamond disc 5 on a sector. It is preferable to divide the surface of the polishing pad 1 into n pieces of sectors 1, 2, . . . , n according to the position of the polishing pad, partial properties of a substrate to be polished in reference to FIG. 6 and to set the conditioning parameters (f, s, v) for every sector.

The present invention is preferably applied to CMP, especially to polishing a wafer, or semiconductive substrate and multi-layered wiring substrate on which device pattern and/or film species such as metallic film, insulating film and the like are formed.

EXAMPLES

The examples of the present invention will be explained as follows in reference to the accompanying drawings.

Example 1

FIG. 1 is an explanatory view of a polishing apparatus of Example 1. As illustrated in FIG. 1, a polishing table 3 with a polishing pad 1 adhered thereto is rotated by a table motor 8. The number of revolution of the polishing table can be detected by an encoder 9 attached to the table motor 8. A signal corresponding to the detected number of revolution (signal corresponding to an actual number of revolution) output by the encoder 9 is input into one input terminal of a negative feedback amplifying circuit 11. Set number of revolution of the polishing table 3 is input into another reference input terminal of the negative feedback amplifying circuit. By the negative feedback amplifying circuit the actual number of revolution of the polishing table is compared with the set number of revolution and a torque current to be supplied to the table motor 8 is controlled so as to make the actual number of revolution approximate or equal to the set number of revolution.

A wafer 2 is held by a spindle 7 through a carrier above the polishing pad 1. In polishing the wafer 2 (run step), a slurry containing an abrasive agent is fed on the polishing pad 1, the polishing table 3 and the spindle 7 are rotated, the wafer 2 is pressed onto the polishing pad 1, which is to be polished by an abrasive agent captured in traps existed on the surface of the polishing pad 1.

The polishing apparatus further includes a conditioning control system 12. The conditioning control system 12 is composed of: an input part into which a torque current detection signal is input from a torque current detection unit which is not shown in any figure; a memory part which stores the value of the torque current detection signal, constant assigned in a formula representing the relation between the variation of the torque current detection signals and that of conditioning load; a setting unit in which a conditioning condition is operated on the basis of the torque current detection signal and the constant stored in the memory unit; and an output part from which a control signal is output to a conditioning driving unit 4 according to the set conditioning condition. By the conditioning driving unit 4 a diamond disc 5 which is a conditioning device is driven according to the input control signal. The diamond disc 5 sweeps the surface of the polishing pad 1 at the same time of polishing according to the set conditioning condition.

Now, the principle of setting a conditioning condition will be explained below.

As indicated by the above formula (9) "Torque current I=constant×$\mu$ (t)=constant×fsvd", the variation (difference) of the torque current ΔI is proportional to the variation (difference) of friction force $\Delta\mu$. Further, the variation of the friction forces is proportional to the variation of conditioning conditions (the following formula (10)).

$$\Delta I = \text{constant} \times \Delta\mu = \text{constant} \times \Delta fsvd \tag{10}$$

When s=C1, v=C2 and d=C3 in the formula (10) with proviso that C1, C2 and C3 are constant, and only f is variable, the formula (10) can be transformed as follows.

$$\Delta I = \text{constant} \times \Delta\mu = \text{constant} \times f \tag{11}$$

The formula (11) indicates that the torque current value I can be controlled to be always constant during polishing by setting the conditioning load f so as to satisfy the relation of "$\Delta\mu$=constant×$\Delta f$".

Figure 7:
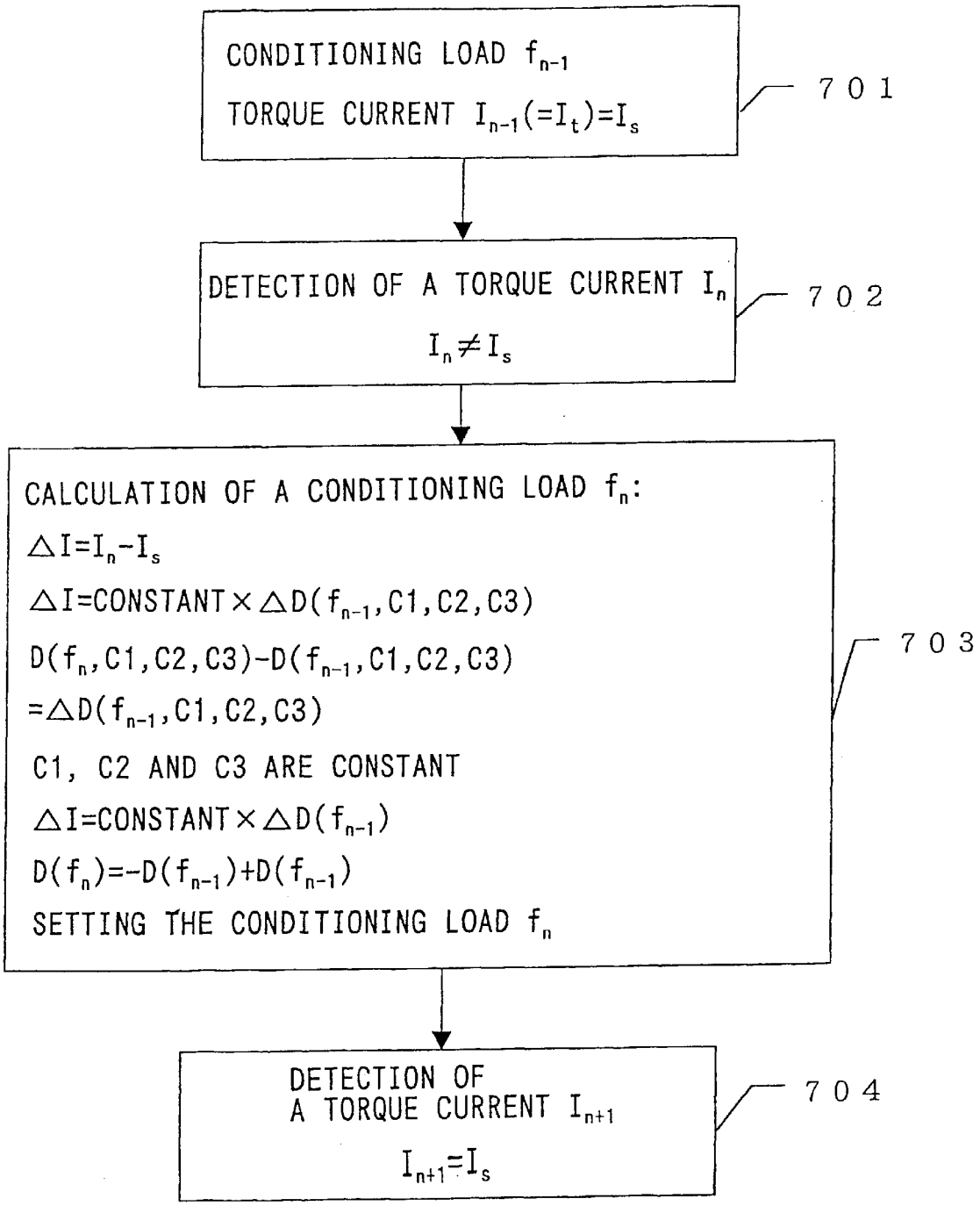
FIG. 7 is an explanatory view of an action of an exemplary polishing apparatus of the present invention.

Next, the action of the conditioning control system will be explained as follows. FIG. 7 is an explanatory view of an action for setting a conditioning condition in a polishing apparatus shown in FIG. 1.

Referring to FIGS. 1 and 7, it is assumed that a torque current In $I_{n-1}$ is conditioned to be equivalent to a target torque current Is by setting (n−1)-th conditioning load $f_{n-1}$ (step 701).

It is assumed that $I_n \neq I_s$ wherein In is n-th torque current detected upon "n"th detection of a torque current In, by a conditioning control system 12 (step 702).

Under these conditions, new conditioning load $f_n$ is determined by the conditioning control system 12 as follows (step 703). At first, determination of $\Delta I = I_n - I_s$ is made provided that a relational equation of "ΔI=constant×ΔD(fn −1, C1, C2, C3)" has been already established according to the above formulae (10) and (11) and that "constant" in this equation has been already determined "D" in the above equation denotes a function of variable conditioning parameter(s). On the other hand, $D(f_n, C1, C2, C3) - D(f_{n-1}, C1, C2, C3) = \Delta D(f_{n-1}, C1, C2, C3)$ is given. In this equation, C1, C2 and C3 are constant. Accordingly, $D(f_n) - D(f_{n-1}) = \Delta D(f_{n-1})$ is established. Similarly, $\Delta I = \text{constant} \times \Delta D(f_{-1})$ is established on the basis of the above equation. New conditioning load $f_n$ can be determined by working out a simultaneous equation consisting of these 2 equations. In this way, a torque current $I_{n+1}$ is controlled to coincide with the target torque current $I_s$ (step 704).

In the above method of setting a conditioning parameter, there are 4 parameters, and 3 parameters among them are fixed. However, the number of parameters can be made 3, for example, by setting the number of the revolution of the polishing table constant, and 2 parameters among them may be fixed to set a conditioning parameter.

Figure 8:
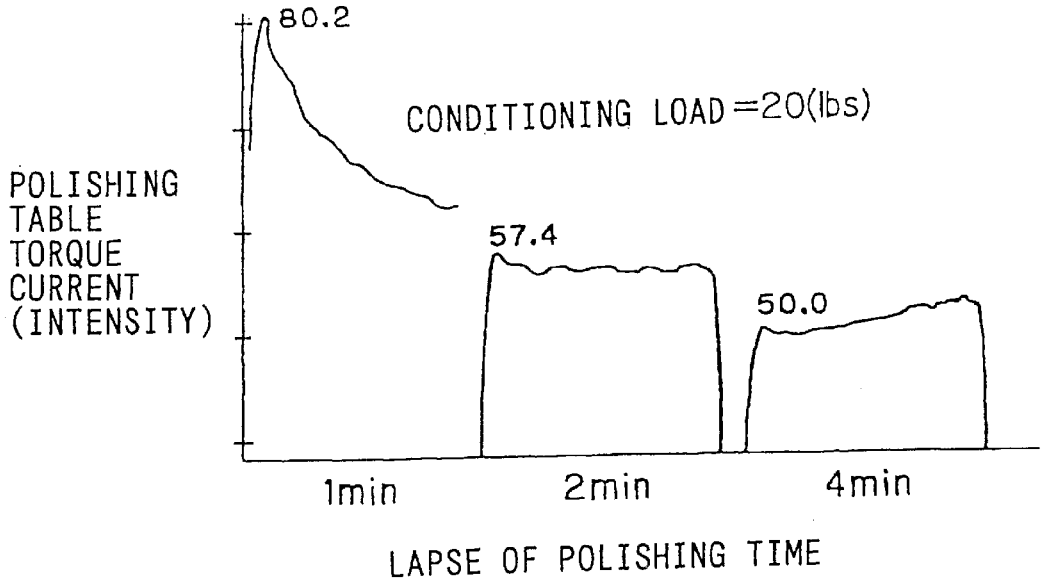
FIG. 8 is a graph showing the relation of a torque current versus the lapse of polishing time in a polishing step after conditioning (conditioning load: 20 lbs).
Figure 9:
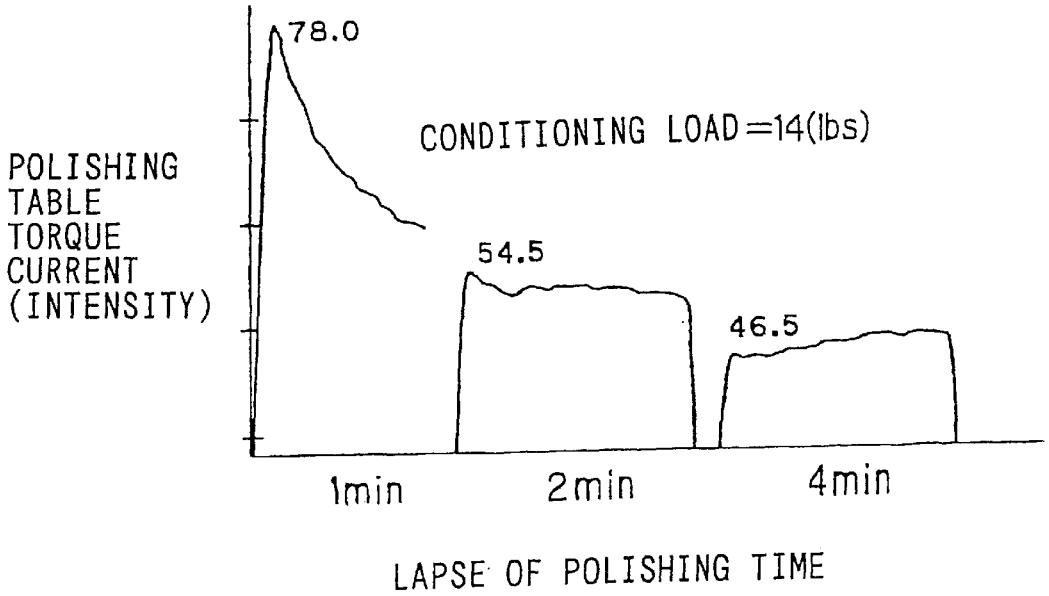
FIG. 9 is a graph showing the relation of a torque current versus the lapse of a polishing time in a polishing step after conditioning (conditioning load: 14 lbs).

Next, the following experiment was carried out in order to make clear that a torque current during polishing the substrate can be controlled by changing the conditioning load. Namely, the torque current during polishing a wafer was measured after conditioning under the conditioning load of 20 lbs or 14 lbs. FIG. 8 is a graph showing the change of a torque current with lapse of time in a run (wafer polishing step) immediately after conditioning under the conditioning load of 14 (lbs). FIG. 9 is a graph showing the change of a torque current with lapse of time which is the same as that of FIG. 8 except that the conditioning load is 20 (lbs). In the above runs, conditioning was not carried out during polishing. Other experimental conditions are just as disclosed above in the paragraph of "PREFERRED EMBODIMENTS OF THE INVENTION".

Comparison of FIGS. 8 and 9 teaches that the maximum torque current value in a run immediately after conditioning becomes high in case that the conditioning load is large. Accordingly, it is obvious that the torque current can be controlled to be constant also in case of carrying out In-SITU conditioning by controlling the conditioning load.

Figure 10:
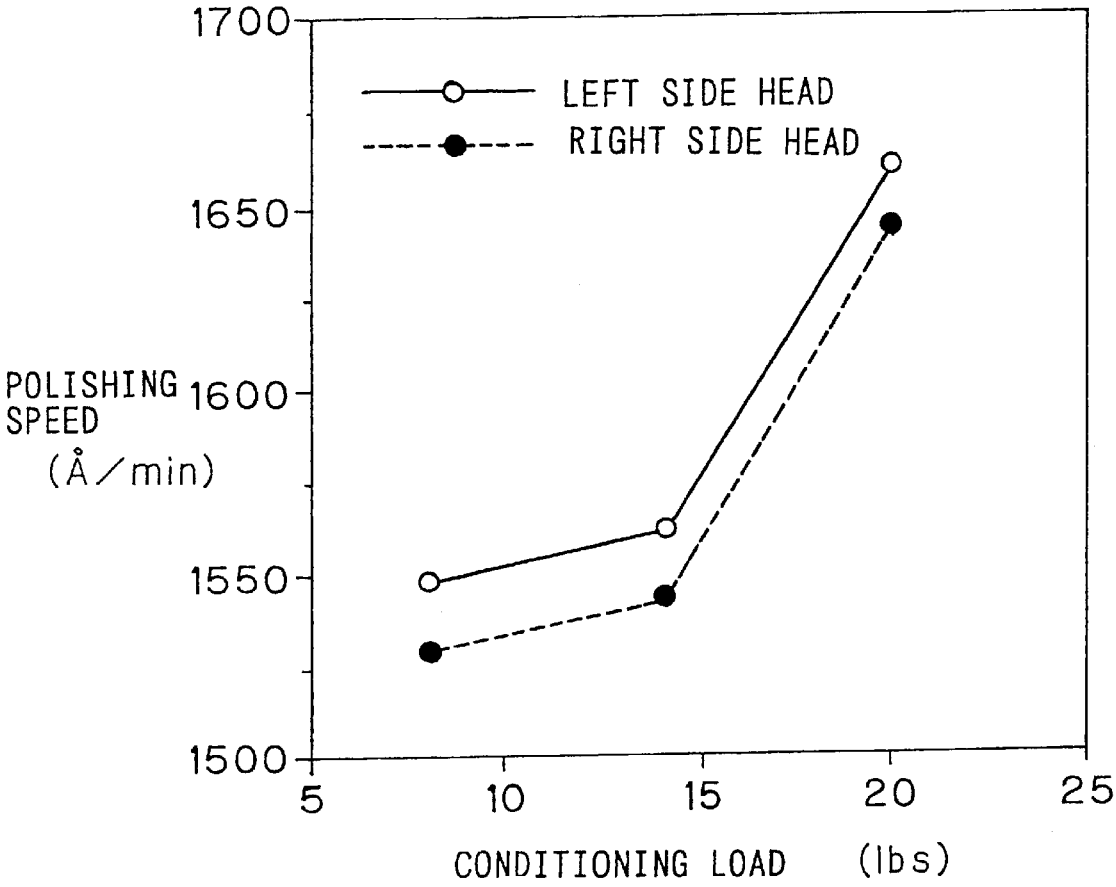
FIG. 10 is a graph showing the relation of a polishing speed versus a conditioning load.

Further, a polishing speed (rate) was determined in the above experiment by measuring the thickness of a wafer after a given period of time lapsed from the start of polishing. FIG. 10 shows the relation of the conditioning load and a polishing speed in a run immediately after conditioning. In FIG. 10, a white (hollow) circle represents datam concerning a wafer mounted on the left side head of the polishing apparatus, and a black (solid) circle represents datam concerning a wafer mounted on the right side head of the polishing apparatus.

FIG. 10 indicates that the polishing speed becomes high by increasing the conditioning load. Accordingly, it will be understood that the polishing speed can be controlled to be constant by controlling the conditioning load.

As shown in FIG. 10, the polishing speed of the wafer mounted on the left side head is different from that of the wafer mounted on the right side head. It is preferable to set a conditioning condition for every sector of the polishing pad taking the difference of a polishing speed due to such a position of the wafer mounted on the head into consideration.

Example 2

In Example 2 the number of revolution of the polishing table during conditioning was varied, although the conditioning load was varied in Example 1. An experiment was made for investigating the relation between the number of revolution of the polishing table during polishing and a polishing speed of a wafer in the run after conditioning provided that other conditioning conditions than the number of revolution of the polishing table are invariable. In this experiment, conditioning was not carried out during polishing. Other experimental conditions were the same as those disclosed above in the paragraph of "PREFERRED EMBODIMENTS OF THE INVENTIONS". Also, other experimental conditions than the number of revolution of the polishing table were the same as those of Example 1. The result of the experiment is shown in FIG. 11.

Figure 11:
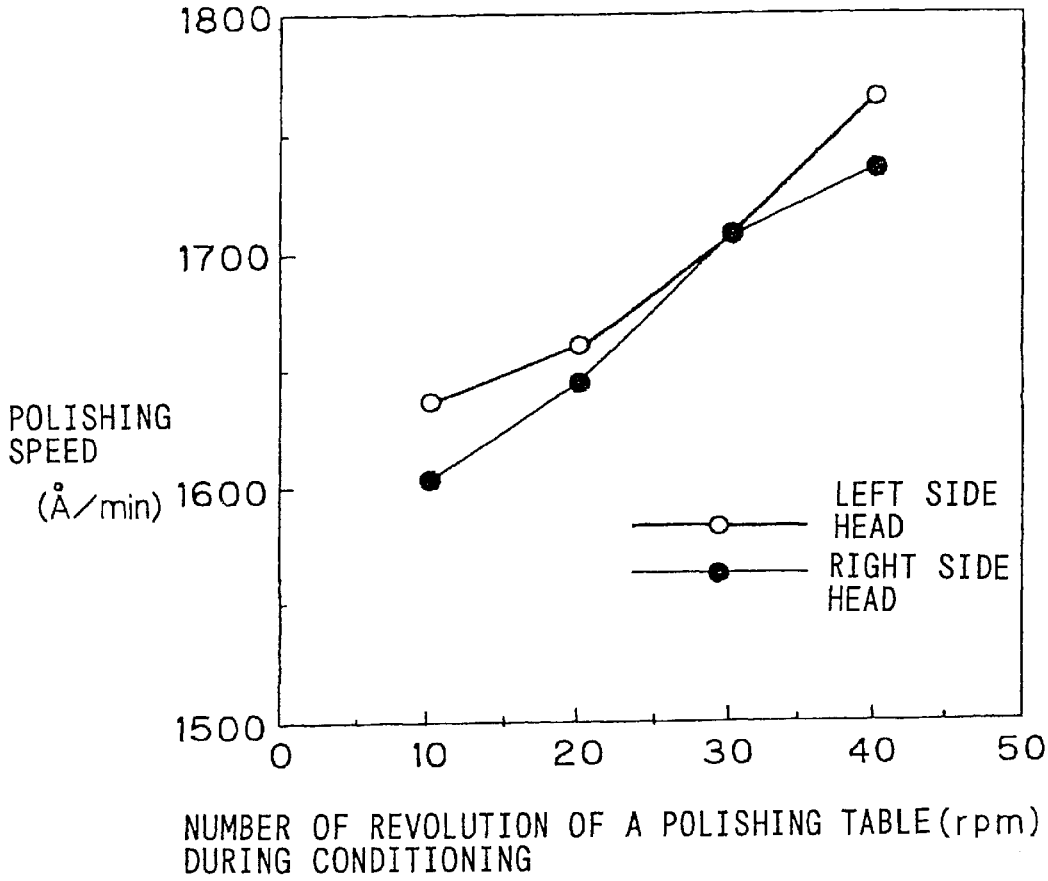
FIG. 11 is a graph showing the relation of a polishing speed after conditioning versus the number of revolution of a polishing table during conditioning.

FIG. 11 indicates that the number of revolution of the polishing table during conditioning is in approximate proportion to the wafer polishing speed, and accordingly that the wafer polishing speed can be controlled to be constant, for example, by temporarily putting a polishing object of a wafer (cf. FIG. 1) out of the way (operation) and changing the number of revolution of the polishing table during conditioning. It will be understood that a torque current can be controlled to be constant by changing the number of revolution of the polishing table during conditioning, since the torque current is proportional to the wafer polishing-speed.

Example 3

In the Examples 1 and 2, the instant torque current was controlled to be invariable in different runs from each other. However, an integrated torque current, which is integrated value or sum of torque currents, flowing for a given period of time, was controlled to be constant at every time to be run in this Example 3.

At first, In-SITU conditioning was preliminarily carried out under the condition of fixed conditioning load (15 lbs). Other experimental conditions were the same as those in the above experiments.

Figure 12:
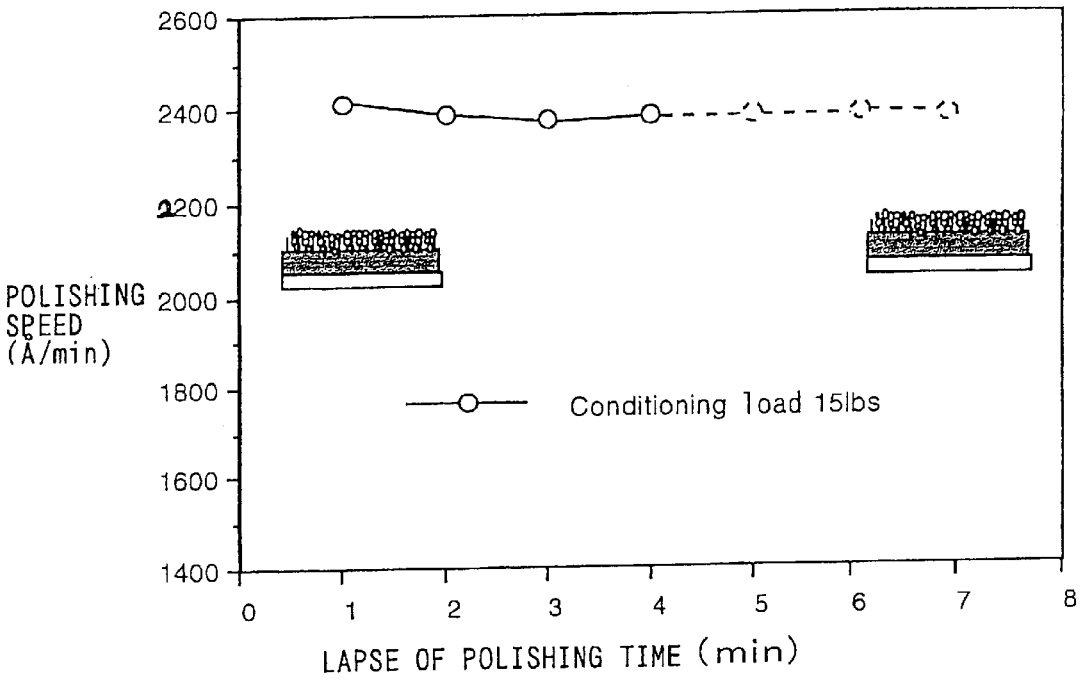
FIG. 12 is a graph showing the change of a polishing speed with lapse of time in case of a fixed conditioning load in In-SITU conditioning.
Figure 13:
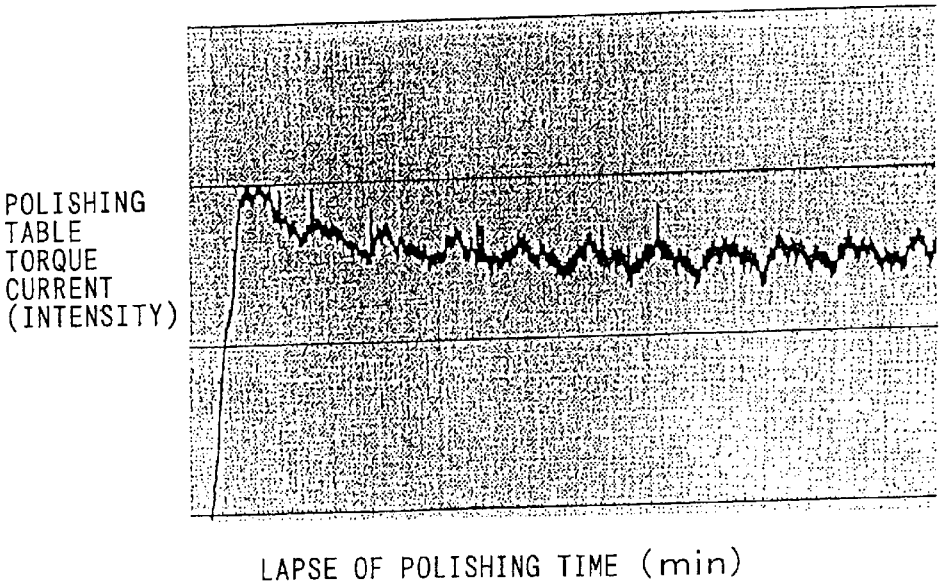
FIG. 13 is a graph showing the change of a polishing table torque current with lapse of time in case where the control is performed so that conditioning load and rotating speed of a polishing table assume constant values.
Figure 14A:
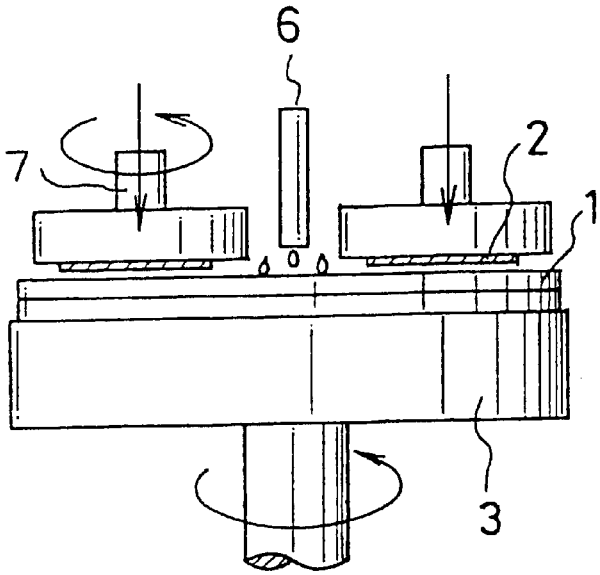
FIG. 14(A) PRIOR ART
FIGS. 14(A) and (B) are an explanatory view of a conventional polishing apparatus.
Figure 14B:
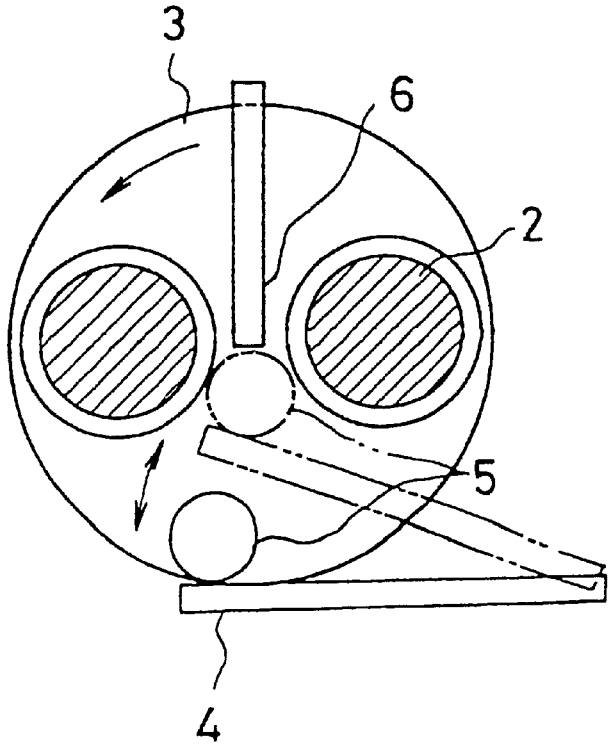
FIG. 14(B) PRIOR ART
FIG. 14(B) is a plan view.

FIGS. 12 and 13 are a graph for explaining the experimental result of this In-SITU conditioning. FIG. 12 shows the change of a polishing speed with lapse of time in case of fixing a conditioning load in In-SITU conditioning, and FIG. 13 shows the change of a polishing table torque current with lapse of time in case of controlling a rotational speed of the polishing table to be constant by fixing the conditioning load in In-SITU conditioning.

FIGS. 12 and 13 indicate that the polishing speed varies depending on the change of the polishing table torque current in case of controlling no conditioning parameter.

The reason why the above result of Example 3 was obtained will be explained as follows.

The following formula is derived from the above formulae (1), (2) and (7).

$$\text{Total polished amount during a period of polishing} = \int I(t)dt = \text{constants} \times \int fsvd \times r(t) \times n(t)dt \quad (12)$$

In case of In-SITU conditioning, r(t)×n(t) or r(t) can be considered constant. Further, total polished amount during a given period of time is a function of "∫fsvd". Accordingly, we can understand that the sum of torque currents during the period, or total polished amount during the period can be controlled by changing conditioning conditions (f, s, v, d) during polishing. Further, a polishing state can be maintained constant by applying the method of setting a conditioning condition disclosed in Example 3, for example, even in the case where the change of the torque current during polishing does not exhibit linearity, or where the surface state of a polishing object varies,during polishing, such as a device pattern.

The meritorious effects of the present invention are briefly mentioned as follows.

First effect of the present invention is that the state of a polishing means can be maintained constant in In-SITU conditioning which is performed at the same time of polishing.

Second effect of the present invention is that polishing can be done with diminishing the influence of fluctuation between lots, fluctuation or difference in pattern between products and the like.

Third effect of the present invention is that constant state of the polishing means can be always maintained even under the variation of patterns during polishing, and accordingly that a polishing speed can be stabilized irrelevantly of polishing time.

Forth effect of the present invention is that it is needless to perform a pilot operation for setting a conditioning condition in the interval of the steps (runs) of polishing a product. This is because information for setting a conditioning condition can be obtained simultaneously with polishing a substrate to become a product.

It should be noted that other objects of the present invention will become apparent in the entire disclosure and that modifications may be done without departing the gist and scope of the present invention as disclosed herein and appended herewith.

Also it should be noted that any combination of the disclosed and/or claimed elements, matters and/or items may fall under the modifications aforementioned.

What is claimed is:

1. A polishing apparatus for polishing a substrate comprising:

a polishing device, a friction force detector arranged to allow measurement of a friction force between the polishing device and the substrate, an in-situ conditioning device acting on a surface of the polishing device, and a conditioning control system which controls said conditioning device based on the friction force exerted between said polishing device and said substrate during, polishing said substrate, so as to allow said conditioning device to perform conditioning, simultaneously with polishing, on said polishing device such that a polishing speed is maintained constant at each polishing step.

2. The polishing apparatus as defined in claim 1, wherein said conditioning control system is capable of controlling said conditioning device so as to keep said friction force exerted between said polishing device and said substrate during polishing said substrate constant.

3. The polishing apparatus as defined in claim 1, wherein said friction force is monitored by a torque current signal corresponding to a torque current which drives said polishing device.

4. The polishing apparatus as defined in claim 1, wherein said conditioning control system is capable of controlling said conditioning device so as to keep said friction force constant based on a torque current signal corresponding to a torque current which drives said polishing device.

5. The polishing apparatus as defined in claim 1, wherein said conditioning control system is capable of controlling said conditioning device so as to keep a torque current signal, that corresponds to a torque current that drives said polishing device, constant.

6. The polishing apparatus as defined in claim 4, which further comprises a torque current detection unit detecting said torque current signal and outputting the same to said conditioning control system, wherein said conditioning control system comprises a setting unit setting a conditioning condition so as to keep the integrated values or sums of said torque currents running during a given period of time constant based on a detection signal input from said torque current detection unit.

7. A polishing apparatus comprising:

a polishing device polishing a substrate, a conditioning device conditioning said polishing device during polishing said substrate, and a conditioning control system which controls said conditioning device based on a friction force exerted between said polishing device and said substrate during polishing said substrate;

wherein said conditioning control system comprises a setting unit setting a conditioning condition so as to keep said friction force constant, said conditioning condition set by said setting unit being selected from one or more parameters selected from the group consisting of conditioning load exerted on said polishing device, number of revolution of said conditioning device, conditioning time, feed or concentration of an abrasive agent, strength of absorbing debris from the top of said polishing device and surface roughness of said conditioning device.

8. The polishing apparatus as defined in claim 7, wherein said setting unit is capable of setting next conditioning load based on the variation amount of a torque current signal corresponding to a torque current which drives said polishing device and present conditioning load.

9. The polishing apparatus as defined in claim 1, wherein said polishing device comprising a polishing table with a polishing pad adhered thereto on which traps for capturing abrasive grains or debris are formed, the relation of said friction force $\mu(t)$ after t hours lapsed from the start of polishing and conditioning condition is represented by the following formula:

$$\mu(t)=r(t)\times n(t)\times h\times X$$

where r(t) is an effective slurry density which contributes to polishing, n(t) is an effective number of traps which are existed on said polishing pad and contribute to polishing, h is a depth of said traps, X is a width of said traps, and r(t)×n(t) are values kept constant due to conditioning during polishing.

10. A method of polishing a substrate which comprises the steps of:

providing a polishing device, polishing the substrate by moving a surface of the polishing device against the substrate, detecting a friction force exerted between the polishing device and the substrate during the polishing step, and conditioning said polishing device during said polishing step using a conditioning device acting on a surface of the polishing device, wherein parameters of the conditioning are determined based on said friction force detected so as to allow said conditioning device to perform conditioning such that a polishing speed is maintained constant at each polishing step.

11. A method of polishing a substrate which comprises the steps of:

providing a polishing device, polishing the substrate by moving a surface of the polishing device against the substrate, detecting a torque current for driving the polishing device during the polishing step, and conditioning said polishing device during said polishing step using a conditioning device acting on a surface of the polishing device, wherein parameters of the conditioning are determined based on said torque current detected so as to allow said conditioning device to perform conditioning such that a polishing speed is maintained constant at each polishing step.

12. The polishing method as defined in claim 11, wherein during the conditioning step, the parameters of the conditioning are based on variations in said torque current and present conditioning parameters.

13. A polishing apparatus comprising:

a polishing device polishing a substrate, a conditioning device conditioning said polishing device during polishing said substrate, and a conditioning control system which controls said conditioning device based on a friction force exerted between said polishing device and said substrate during polishing said substrate;

wherein said polishing device comprising a polishing table with a polishing pad adhered thereto on which traps for capturing abrasive grains or debris are formed, the relation of said friction force $\mu(t)$ after t hours lapsed from the start of polishing and conditioning condition is represented by the following formula:

$$\mu(t)=r(t)\times n(t)\times h\times X$$

where r(t) is an effective slurry density which contributes to polishing, n(t) is an effective number of traps which are existed on said polishing pad and contribute to polishing, h is a depth of said traps, X is a width of said traps, and $r(t) \times n(t)$ are values kept constant due to conditioning during polishing.

14. A polishing apparatus comprising:

a polishing device polishing a substrate, a conditioning device conditioning said polishing device during polishing said substrate, and a conditioning control system which controls said conditioning device based on a friction force exerted between said polishing device and said substrate during polishing said substrate;

wherein said conditioning control system is capable of controlling said conditioning device so as to keep said friction force constant at each polishing step based on a torque current signal corresponding to a torque current which drives said polishing device, wherein said apparatus further comprises a torque current detection unit detecting said torque current signal and outputting the same to said conditioning control system, and wherein said conditioning control system comprises a setting unit setting a conditioning condition so as to keep the integrated values or sums of said torque currents running during a given period of time constant based on a detection signal input from said torque current detection unit.

* * * * *